United States Patent [19]

Keith et al.

[11] 4,411,219

[45] Oct. 25, 1983

[54] APPARATUS FOR PROTECTING THE FRAME SURROUNDING A WINDOW OR DOOR OPENING AND A WINDOW OR DOOR WITHIN THE OPENING

[75] Inventors: Jack L. Keith, Oregon City, Oreg.; Thomas E. Gies, 3227 SW. 25th, Gresham, Oreg. 97030

[73] Assignee: Thomas E. Gies, Gresham, Oreg.

[21] Appl. No.: 351,188

[22] Filed: Feb. 22, 1982

[51] Int. Cl.[3] ..... B05C 21/00

[52] U.S. Cl. ..... 118/505; 51/274

[58] Field of Search ..... 118/505, 504; 427/282; 51/274, 310, 311, 312

[56] References Cited

U.S. PATENT DOCUMENTS

| | | | |
|---|---|---|---|
| 1,605,670 | 11/1926 | Lee | 118/504 |
| 1,623,718 | 4/1927 | Colby | 118/504 |
| 1,697,200 | 1/1929 | Morgana et al. | 118/505 |
| 1,799,913 | 4/1931 | Lemmons | 118/504 |
| 1,817,928 | 8/1931 | Panitzsch | 118/504 |
| 2,045,597 | 6/1936 | Haug | 91/65 |
| 2,545,638 | 3/1951 | Wheatley | 91/65 |
| 3,029,782 | 4/1962 | Eure | 118/505 |
| 4,196,692 | 4/1980 | Vanstrom | 118/504 |
| 4,276,852 | 7/1981 | Adams | 118/326 |

*Primary Examiner*—John P. McIntosh
*Assistant Examiner*—Mary Beth Calligaris
*Attorney, Agent, or Firm*—Klarquist, Sparkman, Campbell, Leigh, Whinston & Dellett

[57] ABSTRACT

A paint guard for protecting frame windows or doors, includes a rectangular framework of four right annular frame members which are telescopically interconnected so as to permit the framework to expand and contract in height and width. Flanges at the periphery of the framework are provided for clamping the framework to the window frame upon contractin of the framework around the window frame. A biasing spring mechanism is provided for urging the framework to its contracted position. The central region of the framework is open. A flexible covering contained in rollers is utilized to cover the opening. Locks are provided to selectively lock certain frame members together for certain applications. A method of protecting a framed window or door during painting is also disclosed.

16 Claims, 7 Drawing Figures

FIG. 2
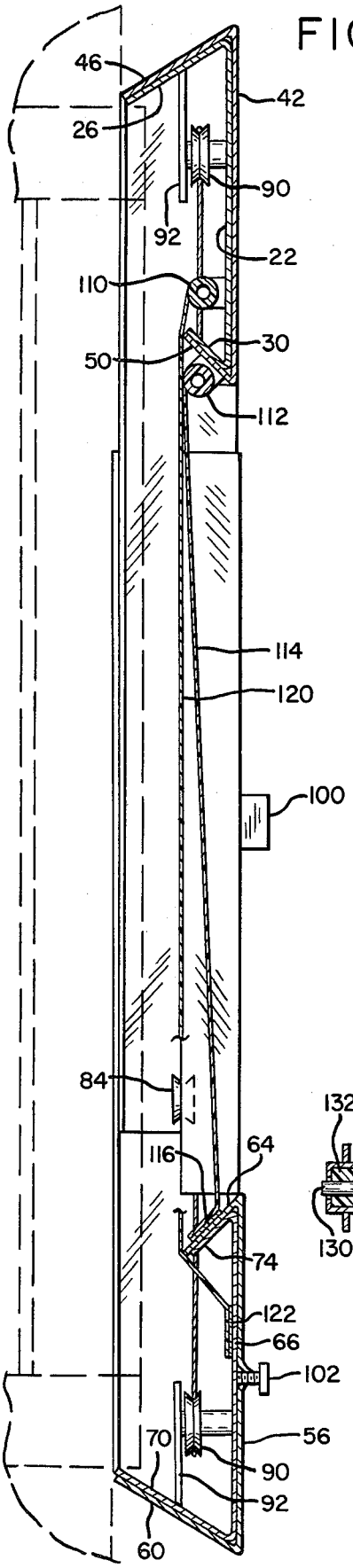
FIG. 3
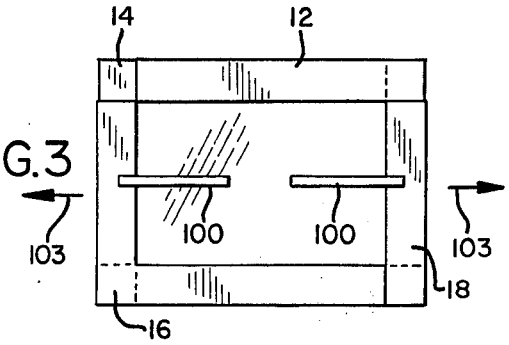
FIG. 4
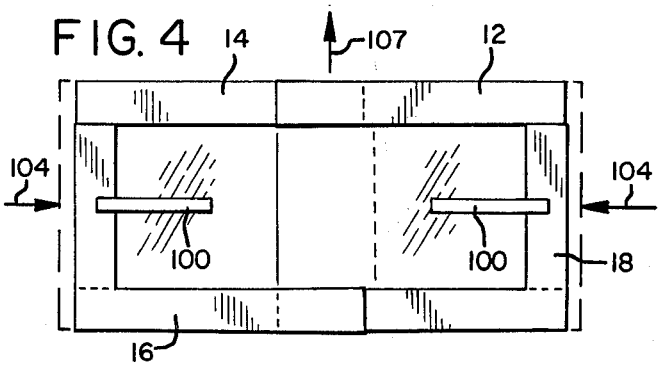
FIG. 5
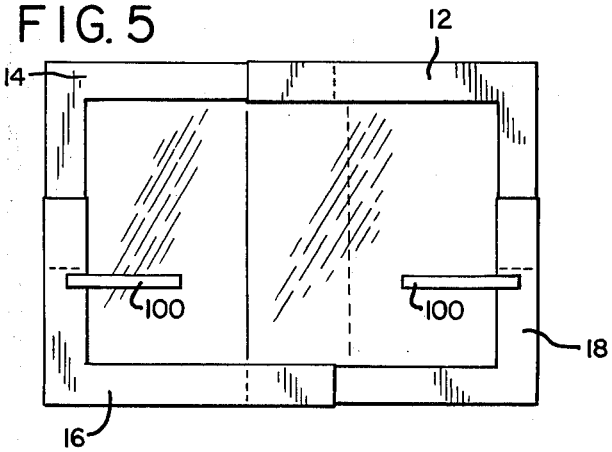
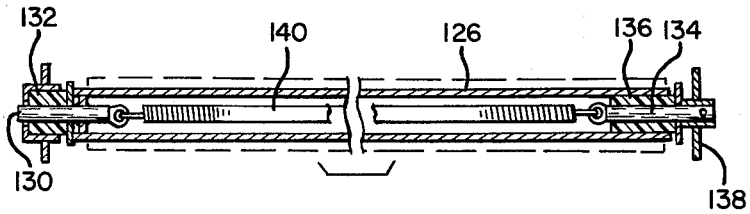
FIG. 6

APPARATUS FOR PROTECTING THE FRAME SURROUNDING A WINDOW OR DOOR OPENING AND A WINDOW OR DOOR WITHIN THE OPENING

BACKGROUND OF THE INVENTION

1. Field of the Invention

The present invention relates to devices and methods of protecting windows or doors, such as during painting of the surrounding building.

2. Description of the Prior Art

Heretofore, windows and doors are typically protected prior to painting by covering them with paper secured in place by masking tape. This process of masking windows is extremely time consuming.

A number of devices have been suggested which partially solve this problem. Among these is the paint shield disclosed in U.S. Pat. No. 1,817,928 of Panitzsch. In Panitzsch, a first set of two slidingly interfitting panels are positioned at the top of the window, the sliding connections permitting adjustment of the panels to the width of the window. A second set of two panels is positioned to cover the lower section of the window. Strings or ties are utilized to secure the upper and lower sets of panels together. Thus, the Panitzsch device does not comprise an interconnected unit for covering an entire window simultaneously. Instead, Panitzsch utilizes separate sets of two panels which are tied together to protect the window.

U.S. Pat. No. 4,196,692 of Vanstrom discloses another paint guard for windows. In Vanstrom, four sections are slidingly interconnected to form a rectangular paint guard. These sections are connected by linking arms to an actuator which, upon rotation, adjusts the sections to fit a window. The outer peripheral edges of the sections are expanded against a window frame to hold the device in place. A construction such as Vanstrom, is relatively mechanically complex and, correspondingly expensive to manufacture.

Therefore, a need exists for a window or door protector which is easy and fast to install and which is mechanically simple.

SUMMARY

It is a primary object of the present invention to provide an apparatus which is easily and rapidly installed for the purpose of protecting a window or door, such as during painting.

It is a further object of the present invention to provide a new method of installing a window or door protector.

It is another object of the invention to provide an apparatus which is expandable and contractable in two dimensions so as to be adaptable to protect windows and doors of various sizes.

It is still another object of the invention to provide such a device which is independently adjustable in two dimensions, for example in width and height.

A further object of the invention is to provide a window or door protector which engages the frame surrounding the window or door as the apparatus is contracted to clamp the apparatus in place.

A still further object of the invention is to provide a window or door protector apparatus which is mechanically simple, durable, and easy to use.

The foregoing and other objects, features and advantages of the present invention will become more apparent from the following detailed description, which proceeds with reference to the accompanying drawings.

BRIEF DESCRIPTION OF THE DRAWINGS

In the drawings:

FIG. 2 is a vertical sectional view of the apparatus of FIG. 1, taken along line 2—2 of FIG. 1, showing it installed on a window frame;

FIG. 3 is a front elevational view of the apparatus as it is being installed on a window frame;

FIG. 4 is another front elevational view of an apparatus during a later step of the installation;

FIG. 5 is a front view of the apparatus with the installation complete;

FIG. 6 is a longitudinal sectional view of a roller portion of the apparatus, taken along line 6—6 of FIG. 1.

DETAILED DESCRIPTION OF THE PREFERRED EMBODIMENT

The window or door protecting apparatus of the present invention is designed for quick application to the frame surrounding a window or door for the purpose of guarding the window or door from paint overspray as the adjoining portion of the building structure is painted. Of course, the apparatus is capable of protecting the window or door during the course of other activities besides painting.

The description will proceed with reference to applying the apparatus to the frame surrounding a window, although it is to be understood that the apparatus is equally suitable for protecting doors and the like. Thus, the term window or door are to be construed to include other framed or partially framed openings as well.

Figure 1:
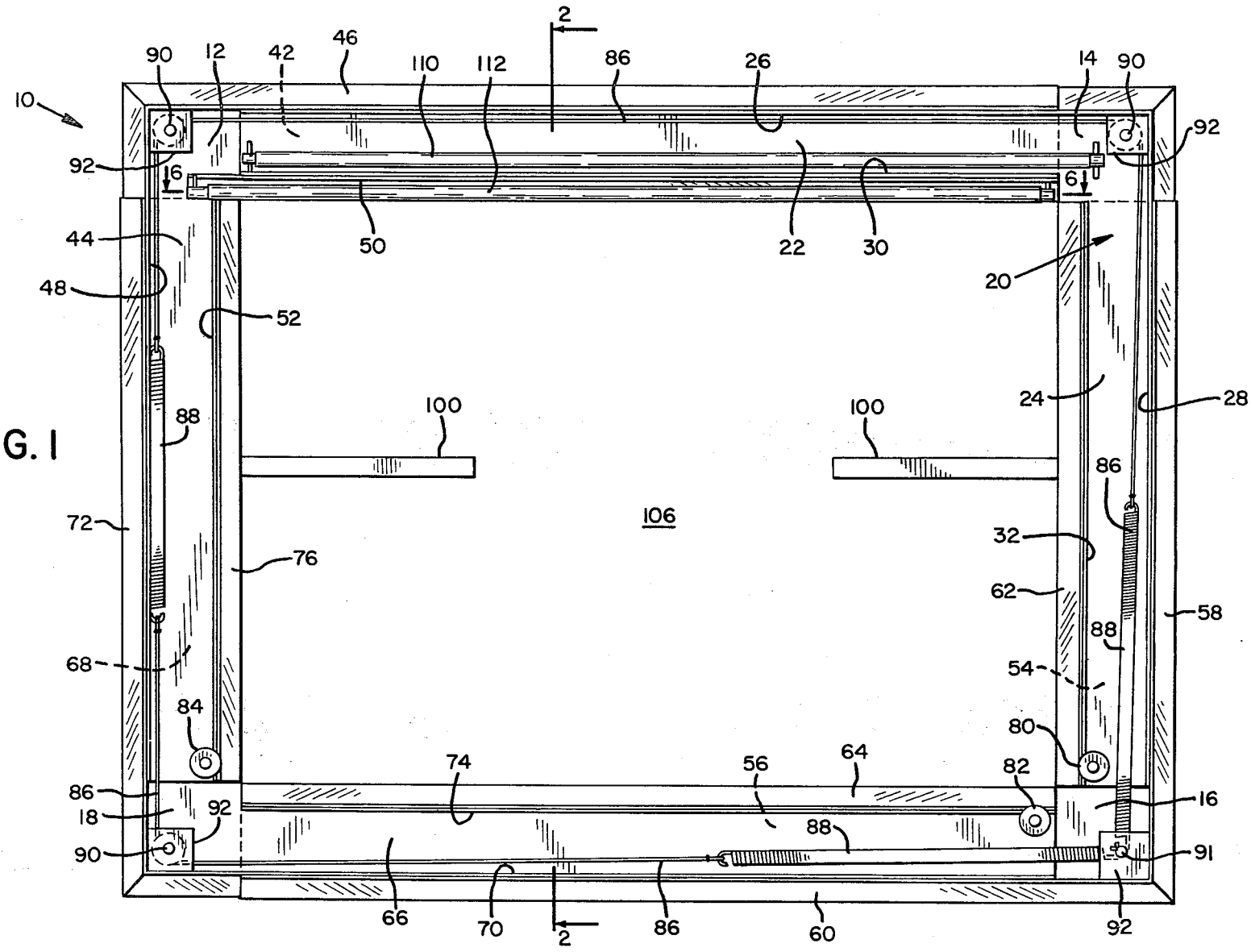
FIG. 1 is an elevational view of the back side of a window or door protector apparatus in accordance with the invention, with the apparatus shown in its contracted position.
Figure 7:
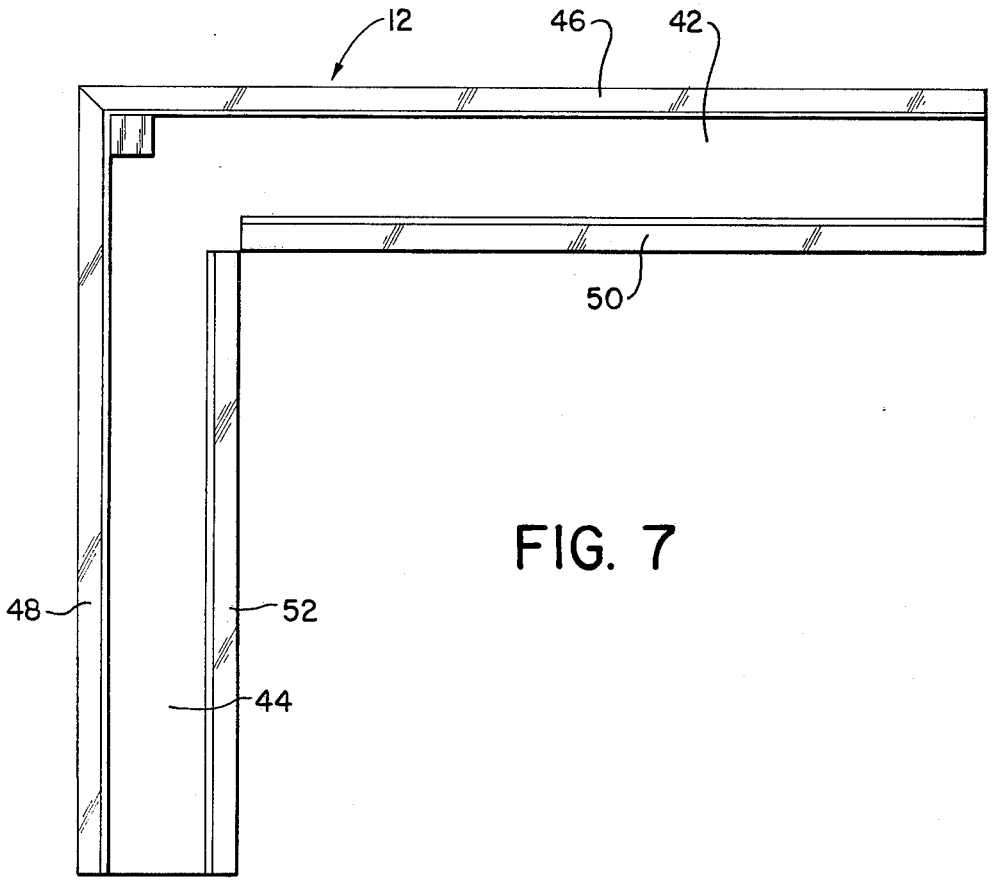
FIG. 7 is an elevational view of a frame member of the apparatus.

With reference to FIGS. 1 and 2, the apparatus 10 comprises an upright generally rectangular framework formed from four slidably interconnected, right angular frame members 12, 14, 16 and 18. These members are telescopingly interconnected so that the framework is expandable and contractable in two dimensions, that is, for example, width and height. Furthermore, the height of the framework may be changed independently of changes in the width of the framework to accommodate windows and doors of varying sizes.

As best seen in FIG. 1, with reference to frame member 14, these frame members include an L-shaped body 20 with first and second angularly disposed legs 22, 24. These frame members are preferably of a durable, easily cleaned material, such as aluminum. Inwardly directed window frame gripping flanges 26, 28 are formed at the outer peripheral margins of legs 22, 24. In addition, second inwardly directed flanges or lips 30, 32 are formed at the inner margins of the respective legs 22, 24. Each of the other frame members is formed in a similar manner. Thus, frame member 12 has legs 42, 44 with respective outer flanges 46, 48 and inner lips 50, 52. Frame member 16 has legs 54, 56 with respective outer flanges 58, 60, and inner lips 62, 64. In addition, frame member 18 has legs 66, 68 with respective outer flanges 70, 72 and inner lips 74, 76.

With this construction, the frame members telescopingly engage one another as best seen in FIG. 2 with the flanges retaining the framework in its assembled condition.

An optional roller guide 80, mounted to leg 24 of frame member 14 engages the lip 62 of frame member 16 to guide these frame members as they slide relative to one another. A similar roller 82 is mounted to leg 68 of frame member 18, and still another such roller 84 is mounted to the leg 44 of frame member 12 for the same purpose. As a result the frame members may be easily expanded and contracted.

The framework is continuously biased to its contracted position shown in FIG. 1 by a biasing mechanism. In FIG. 1, this mechanism comprises resilient line means and may specifically comprise a line, including cable sections 86, and spring sections 88, which extends between the four corners of the framework. Pin and roller assemblies 90 are positioned at three of the corners. A pin 91 is positioned at the fourth corner. The line is passed around these assemblies 90 and pin 91. More specifically, spring sections 88 are connected to pin 91 while line sections 86 pass around the rollers of assemblies 90. Also, cover plates 92 are positioned at the corners of the framework to protect the pulley assemblies against impact by the window frame when the apparatus is installed. Thus, as can be seen in FIG. 2, the outer peripheral flanges are biased by the biasing mechanism against the window frame of the window which is to be protected. Also, the cover plates 92 are offset from the free edge of the outer flanges so as to not interfere with the engagement of the window frame by these flanges.

Handles 100 are mounted to the side rails of the framework and may be gripped when expanding the framework to surround the window frame. Optional locks such as set screws 102 (FIG. 2) may be provided for selectively locking certain of the frame members together during certain applications. For example, assume that the bottom edge of a door is unframed. In such a case, the legs of the frame members at the sides of the framework are locked together. This fixes the height of the framework until such time as the locks are released. Thus, even though there is no bottom door frame to be gripped by the outer peripheral flanges of the apparatus, the framework is still suitable for protecting the door.

As can be seen in FIG. 1, the framework has an open central region 106, which, if uncovered, would permit paint to reach the window. For this reason, a cover is provided and affixed to the framework for covering this space.

In the illustrated embodiment, this cover comprises sheets of flexible material housed within holders or rollers 110, 112 and positioned along the top rail of the framework. More specifically, roller 110 is mounted to the back surface of leg 22 while roller 112 is mounted to lip 50. A sheet of flexible material 114 (FIG. 2), such as of polyethylene, is extended from roller 112 and secured by a suitable fastener, such as double backed adhesive tape 116 to the lip 64 of leg 56. Thus, sheet 114 covers a portion of the opening 106. In the same manner, a sheet of flexible material 120 is extended from roller 110 and secured, as by double-backed adhesive tape 122, to the leg 66 at the bottom of the framework. As can be seen in FIG. 1, the rollers 110, 112 are positioned in overlapping relationship so that they will overlap one another regardless of the extent to which the width of the framework is extended. Consequently, the adjacent side edges of sheets 114, 120 also overlap one another when covering the opening.

With reference to FIG. 6, the rollers include an outer shell 126 which is fixedly connected to a pin 130 at one end. The shell 126 is also rotatably connected by bearings 136 to a pin 134 at its other end. The pin 130 is rotatably mounted by bearings 132 to the framework. Also, pin 134 is fixedly mounted by a mounting bracket 138 to the framework. A spring 140 extends from plug 130 to plug 134. Consequently, as the sheet material is unrolled from the shell 126, the shell rotates and tightens spring 140. Thus, the roller automatically retracts the sheet material when it is released.

As can be seen in FIG. 3, viewed from the front, the side rails of the frame are formed by having the side legs of the lower frame members 16, 18 overlie and receive the side legs of the upper frame members 14 and 12. This enables the framework to be mounted in the following manner. The handles 100 are grasped and used to expand the width of the framework, as indicated by arrows 103, until the framework is larger than the window to be protected. Thereupon, the outer flange at the lower edge of the framework is hooked on the bottom portion of the window frame. In addition, the sides of the framework are allowed to contract, as indicated by arrows 104, until the peripheral flanges of the side edges of the framework engage the side portions of the window frame. Thereafter, the upper rail of the framework is pushed upwardly, in the direction of arrow 107, to adjust the height of the framework until the upper peripheral flange surrounds the upper portion of the window frame as shown in FIG. 5 with the installation complete.

Therefore, with the apparatus of this invention, the window can be protected within a matter of seconds.

Having illustrated and described the principles of my invention with reference to one preferred embodiment, it should be apparent to those persons skilled in the art that such invention may be modified in arrangement and detail without departing from such principals. I claim as my invention all such modifications as come within the true spirit and scope of the following claims.

I claim:

1. An apparatus for protecting the frame surrounding a window or door opening and a window or door within the opening comprising:

a rectangular framework comprising plural frame members which are slidably interconnected so as to permit the framework to expand and contract in two dimensions;

biasing means mounted to said framework for contracting the framework; and said framework including engagement means for engaging the periphery of the window or door frame to clamp the framework to such frame and cover the frame upon contraction of the framework.

2. An apparatus according to claim 1 in which said frame members comprise slidably interfitting L-shaped members.

3. An apparatus according to claim 1 including means for selectively locking certain of said frame members together to prevent relative sliding movement of the locked frame members.

4. An apparatus according to claim 1 in which said frame members are telescopingly interconnected.

5. An apparatus according to claim 1 which includes four telescopingly interfitting right angular frame members, said frame members being interconnected to form an upright framework with a top rail, a bottom rail and a pair of side rails, said frame members being interconnected such that the portions of said frame members forming the lower sections of said side rails telescopingly receive the portions of said frame members forming the upper sections of said side rails.

6. An apparatus according to claim 1 in which said engagement means comprises first inwardly directed frame gripping flanges formed at the outer peripheral margins of said frame members, said frame gripping flanges engaging the periphery of the window or door frame to cover the first as the framework is contracted to thereby clamp the framework in place.

7. An apparatus according to claim 6 in which a second inwardly directed flange is provided at the inner margin of each frame member.

8. An apparatus according to claim 7 including roller guide means for engaging said second flanges and guiding the relative sliding movement of said frame members.

9. An apparatus according to claim 1 in which said biasing means comprises spring means mounted to said framework.

10. An apparatus according to claim 1 in which said frame members each include a body of right angular construction, said biasing means includes plural pin means, each pin means projecting outwardly from the corner of the body of a respective one of said frame members, and resilient line means coupled to each said pin means so as to urge the corners of said frame members and hence the frame members to a contracted position.

11. An apparatus according to claim 10 in which each said pin means includes a pin and a roller, said resilient line means including cable sections and at least one spring section, said line means passing around said rollers so as to urge the framework to a contracted position.

12. An apparatus according to claim 11 in which the peripheral margin of each frame member comprises a first frame gripping flange projecting from the body in the same general direction as the pin which is mounted to the body, the first flange projecting outwardly beyond the end of the pin, each frame member including a cover plate positioned at the corner of the frame member so as to overhang and protect the roller, which is mounted to the body of the frame member, from impact, the cover plate being offset from the free edge of the first flange of the first flange to thereby permit the free edge to grip the window or door frame when the framework contracts.

13. An apparatus according to claim 1 in which the two dimensions are height and width, said framework being interconnected so as to be adjustable in height independently of width.

14. An apparatus for protecting the frame surrounding a window or door opening and a window or door within the opening comprising:

plural angular frame members slidably interconnected to form an upright rectangular framework which is expandable and contractable in width and height, said framework having a top rail, a bottom rail, and first and second side rails with an open central region defined between said rails;

means mounted to the framework for releasably securing the framework to the window or door frame to cover the frame upon contraction of the framework around the frame; and cover means mounted to the framework for covering the open central region.

15. An apparatus according to claim 14 in which said cover means comprises flexible cover sheet means, said apparatus also including cover sheet holder means mounted to said framework within which said cover sheet means is positioned when not covering the open central region.

16. An apparatus according to claim 14 in which said frame members each have a pair of legs, a first leg of one frame member and a second leg of another frame member interfit to form a top rail of said framework, said apparatus including first roller means mounted to said first leg and retractably containing a first flexible sheet of cover material therein, said first roller means being positioned such that said first sheet covers a portion of the open central region when extended from the first roller means, second roller means mounted to said second leg and retractably containing a second flexible sheet of cover material therein, said second roller means being positioned such that said second sheet covers the remaining portion of the open central region when extended from the second roller means with the adjacent side edges of said first and second sheets overlapping one another.

* * * * *

UNITED STATES PATENT AND TRADEMARK OFFICE

CERTIFICATE OF CORRECTION

PATENT NO. : 4,411,219

DATED : October 25, 1983

INVENTOR(S) : Jack L. Keith and Thomas E. Gies

It is certified that error appears in the above-identified patent and that said Letters Patent are hereby corrected as shown below:

In the Abstract:

Line 2, "annular" should be --angular--.

Line 7, "contractin" should be --contraction--.

Claim 6, line 15, "first" should be --frame--.

Signed and Sealed this

*Twenty-eighth* Day of *February 1984*

[SEAL]

*Attest:*

GERALD J. MOSSINGHOFF

*Attesting Officer*

*Commissioner of Patents and Trademarks*